United States Patent [19]

Noro et al.

[11] Patent Number: 4,949,384

[45] Date of Patent: Aug. 14, 1990

[54] DRIVING APPARATUS

[75] Inventors: Masao Noro; Daisuke Suzuki, both of Hamamatsu, Japan

[73] Assignee: Yamaha Corporation, Hamamatsu, Japan

[21] Appl. No.: 414,188

[22] Filed: Sep. 28, 1989

[30] Foreign Application Priority Data

Sep. 30, 1988 [JP] Japan ..... 63-127434[U]

[51] Int. Cl.[5] ..... H04R 3/00

[52] U.S. Cl. ..... 381/96; 381/123

[58] Field of Search ..... 381/96, 98, 59, 123, 381/120, 121

[56] References Cited

U.S. PATENT DOCUMENTS

| | | | |
|---|---|---|---|
| 4,180,706 | 12/1979 | Bakgaard | 381/96 |
| 4,281,314 | 7/1981 | Hunt | 381/123 |
| 4,555,797 | 11/1985 | Nieuwendijk et al. | 381/96 |
| 4,583,245 | 4/1986 | Gelow et al. | 381/96 |
| 4,691,361 | 9/1987 | Yoshino et al. | 381/123 |

FOREIGN PATENT DOCUMENTS

| | | | |
|---|---|---|---|
| 2718940 | 11/1977 | Fed. Rep. of Germany | 381/96 |
| 3637666 | 5/1988 | Fed. Rep. of Germany | 381/96 |

*Primary Examiner*—Forester W. Isen

*Attorney, Agent, or Firm*—Spensley Horn Jubas & Lubitz

[57] ABSTRACT

A driving apparatus for driving an electro-acoustic transducer comprises a power amplifier for supplying a drive power to the transducer, and a feedback circuit for generating a negative impedance. The feedback circuit has a main body portion connected to the amplifier and a control information storage body for storing control information for setting transmission characteristics of the feedback circuit. The storage body is arranged to be disconnected/connected to the main body portion. The main body portion comprises a plurality of transducer connection terminals connected to a plurality of transducers, respectively, a plurality of relays and normally-open contacts for selectively supplying an amplifier output to the transducer connection terminals. A transducer selection information is housed in the control information storage body. Thus, when the control information storage body is mounted in the main body portion in accordance with the transducer selection information, a relay and a contact is operated, the amplifier output is supplied to a predetermined transducer.

10 Claims, 5 Drawing Sheets

DRIVING APPARATUS

BACKGROUND OF THE INVENTION 1. (Field of the Invention)

The present invention relates to a driving apparatus for driving an electro-acoustic transducer such as a speaker unit constituting a speaker system so that output characteristics of the transducer are improved and, more particularly, to a driving apparatus which comprises a plurality of transducer connection terminals, and can switch its driving characteristics and a transducer connection terminal by replacing a control information storage body such as a cartridge, thus preventing a wrong combination of the electro-acoustic transducer and the control information storage body.

2. (Description of the Prior Art)

As a conventional driving apparatus for driving a speaker unit assembled in a speaker system, a power amplifier whose output impedance is substantially zero is generally used. A conventional speaker system is arranged to exhibit optimal acoustic output characteristics when it is constant-voltage driven by such a power amplifier whose output impedance is substantially zero.

FIG. 6 is a sectional view of a conventional closed type speaker system. As shown in the Figure, a hole is formed in the front surface of a closed cabinet 1, and a dynamic speaker unit 3 having a diaphragm 2 is mounted in this hole.

A resonance frequency $f_{oc}$ of this closed type speaker system is expressed by:

$$f_{oc}=f_o(1+S_c/S_o)^{\frac{1}{2}}\ \text{Tm} \quad (1)$$

A Q value $Q_{oc}$ of this speaker system is expressed by:

$$Q_{oc}=Q_o(1+S_c/S_o)^{\frac{1}{2}}\ \text{Tm} \quad (2)$$

where $f_o$ and $Q_o$ are respectively the lowest resonance frequency and Q value of a dynamic speaker unit 3, i.e., the resonance frequency and Q value when this speaker unit 3 is attached to an infinite plane baffle. $S_o$ is the equivalent stiffness of a vibration system, and $S_c$ is an equivalent stiffness of the cabinet 1.

In the closed type speaker system, the resonance frequency $f_{oc}$ serves as a standard of a base sound reproduction limit of a uniform reproduction range, i.e., a lowest reproduction frequency. The Q value $Q_{oc}$ relates to a reproduction characteristic curve around the resonance frequency $f_{oc}$. If the Q value $Q_{oc}$ is too large, the characteristic curve becomes too sharp around $f_{oc}$. If the Q value $Q_{oc}$ is too small, the characteristic curve becomes too moderate. In either case, the flatness of the frequency characteristics is impaired. The Q value $Q_{oc}$ is normally set to be about 0.8 to 1.

FIG. 7 is a sectional view showing an arrangement of a conventional phase-inversion type (bass-reflex type) speaker system. In the speaker system shown in the Figure, a hole is formed in the front surface of a cabinet 1, and a dynamic speaker unit 3 having a diaphragm 2 is mounted in the hole. A resonance port (bass-reflex port) 8 having a sound path 7 is arranged below the speaker unit 3. The resonance port 8 and the cabinet 1 form a Helmholtz resonator. In this Helmholtz resonator, an air resonance phenomenon occurs due to an air spring in the cabinet 1 as a closed cavity and an air mass in the sound path 7. A resonance frequency $f_{op}$ is given by:

$$f_{op}=c(A/lV)^{\frac{1}{2}}/2\pi\ \text{TM} \quad (3)$$

where c is the velocity of sound, A is the sectional area of the sound path 7, l is the length of the neck of the sound path 7, and V is the volume of the cabinet 1. In a conventional bass-reflex type speaker system according to a standard setting, such a resonance frequency $f_{op}$ is set to be slightly lower than the lowest resonance frequency $f_{oc}'(\approx f_{oc})$ of the speaker unit 3 which is assembled in the bass-reflex type cabinet 1. At a frequency higher than the resonance frequency $f_{op}$, the sound pressure from the rear surface of the diaphragm 2 inverts its phase oppositely in the sound path 7, whereby the direct radiation sound from the front surface of the diaphragm 2 and the sound from the resonance port 8 are in-phase in front of the cabinet 1, thus constituting an in-phase addition to increase the sound pressure. As a result of the inphase addition, the lowest resonance frequency of the system is lowered to the resonance frequency $f_{op}$ of the resonator. According to an optimally designed bassreflex type speaker system, the frequency characteristics of an output sound pressure can be expanded even to below the lowest resonance frequency $f_{oc}'$ and $f_0$ of the speaker unit 3. As indicated by an alternate one long and two short dashed line in FIG. 8, a uniform reproduction range can be extended wider than those of the infinite plane baffle (indicated by a solid line) and the closed baffle (indicated by an alternate long and short dashed line).

In equations (1) and (2), the equivalent stiffness $S_c$ is inversely proportional to a volume V of the cabinet 1. Therefore, when the speaker system shown in FIG. 6 or 7 is constant-voltage driven, its frequency characteristics, in particular, low-frequency characteristics are influenced by the volume V of the cabinet 1. Thus, it is difficult to make the cabinet 1 and the speaker system compact without impairing the low-frequency characteristics.

For example, in order to compensate for bass-tone reproduction capacity decreased due to a reduction in size of the cabinet, as shown in FIGS. 9(*a*) to 9(*d*), a system of boosting a bass tone by a tone control, a graphic equalizer, a special-purpose equalizer, or the like of a driving amplifier can be employed. In this system, a sound pressure is increased by increasing an input voltage with respect to a frequency range below $f_{oc}$ which is difficult to reproduce. With this system, the sound pressure can be increased at frequencies below $f_{oc}$. However, bad influences caused by high $Q_{oc}$ which is increased due to a speaker unit disposed in a compact cabinet 5, such as poor transient response at $f_{oc}$ caused by high $Q_{oc}$, an abrupt change in phase at $f_{oc}$ due to high $Q_{oc}$, and the like, cannot be completely eliminated. Therefore, the sound pressure of a bass tone is merely increased, and sound quality equivalent to that of a speaker system which uses a cabinet having an optimal volume V and appropriate $f_{oc}$ and $Q_{oc}$ cannot be obtained.

Furthermore, in the bass-reflex type speaker system shown in FIG. 7, if flat frequency characteristics upon constant-voltage driving are to be obtained, for example, the Q value $Q_{oc}'$ of the speaker unit 3 assembled in the bass-reflex cabinet is set to be $Q_{oc}'=1/\sqrt{3}$, and the resonance frequency $f_{oc}'$ is set to be $f_{oc}'=f_{oc}/\sqrt{2}$. In this manner, characteristics values ($f_o$ and $Q_o$) of the speaker unit 3, the volume V of the cabinet 1, and dimensions (A and l) of a resonance port 8 must be matched with high precision, resulting in many design limitations. $Q_{oc}'$ and $F_{oc}'$ can be approximated by $Q_{oc}$ and $f_{oc}$ in equations (1) and (2).

FIG. 10 shows a circuit for equivalently generating a negative impedance disclosed in U.S. Pat. application No. 07/286,869 previously filed by the same assignee. According to a driver system using the circuit for generating a negative impedance (to be referred to as negative resistance driving system hereinafter) as a driving apparatus for a speaker system and causing an output impedance to include a negative resistance $-R_0$ to eliminate or invalidate the voice coil resistance $R_V$ of a speaker, the $Q_{oc}$ and $Q_{oc}'$ can be decreased and $Q_{op}$ can be increased as compared to those when the speaker is constant-voltage driven by the power amplifier having an output impedance of zero. Thus, the speaker system can be rendered compact, and acoustic output characteristics can be improved.

However, an amplifier to which the negative resistance driving system of said prior application is applied has a one-to-one correspondence with a speaker system. Thus, one amplifier cannot be used for driving a plurality of types of speaker systems.

The reason for this is as follows. In the negative resistance driving method, the negative resistance value $-R_0$ must satisfy $R_0 < R_V$ with respect to the voice coil resistance $R_V$ in order to avoid an oscillation caused by excessive positive feedback. Since frequency characteristics of an output sound pressure from the speaker system driven in accordance with this negative resistance value $-R_0$ change, a change in frequency characteristics must be compensated for in addition to control of the negative resistance value $-R_0$. However, at present, such a compensation, e.g., an equalization fitting to a kind of music to be played may be performed by a graphic equalizer or the like. However, it is relatively difficult for many users to optimally adjust even only frequency characteristics. Therefore, it is almost impossible for many users to optimally perform both control of the negative resistance value $-R_0$ and compensation and setting of a change in frequency characteristics.

Thus, Nagi et al. proposed a driving apparatus using a circuit for generating a negative impedance, in which data of the negative resistance $-R_0$ and frequency characteristics are stored in a control information storage body, and the storage body is set or replaced, so that optimal output characteristics of each speaker system can be easily set, and filed an application concerning this apparatus as U.S. application No. 07/353,444 assigned to the same assignee.

In such a driving apparatus, however, when there are a plurality of pairs of control information storage bodies and speaker systems, if a control information storage body to be set in the driving apparatus or a speaker system connected to this driving apparatus is erroneously selected, designed characteristics cannot be obtained. In the worst case, the negative resistance $-R_0$ becomes too large with respect to the voice coil resistance $R_V$ of the speaker, i.e., $R_0 > R_V$, and the speaker may cause oscillation. Also, if each of the control information storage bodies must have different connector specifications, system compatibility may be impaired.

SUMMARY OF THE INVENTION

It is an object of the present invention to provide a driving apparatus in which when a control information storage body is set, a speaker system paired with the set control information storage body is automatically selected, and a wrong selection of a control information storage body and a speaker system can be prevented.

In order to achieve the above object, according to the present invention, there is provided a driving apparatus which comprises a power amplifier for supplying a drive power to an electro-acoustic transducer and a feedback circuit for detecting an input or an output of the transducer to transmit the detected input or output to an input side of the amplifier, and which drives the transducer to cancel a counteraction from a surrounding portion to a vibrating body of the transducer and sets or switches output characteristics by setting or replacing a control information storage body storing control information corresponding to various transducers, wherein a plurality of transducer connection terminals are arranged, transducer selection information means is stored in the control information storage body, and when the control information storage body is mounted, an output of the amplifier is selectively supplied to one of the plurality of transducer connection terminals in accordance with transducer selection information of the mounted control information storage body.

In this arrangement, the speaker systems are connected to the corresponding transducer connection terminals of the driving apparatus, and a number of the connection terminal to which a speaker system paired with a given control information storage body is connected is set in the given control information storage body as transducer selection information. Thus, when the control information storage body is mounted, the connection terminal, i.e., the speaker system, indicated by the transducer selection information set in the control information storage body is automatically selected.

According to the present invention, since a speaker system can be automatically selected in accordance with a mounted control information storage body, selection of a wrong pair of a control information storage body and a speaker system can be greatly eliminated. In an acoustic system having a large number of pairs of control information storage bodies and speaker systems, system compatibility will not be impaired.

DETAILED DESCRIPTION OF THE PREFERRED EMBODIMENTS

An embodiment of the present invention will now be described with reference to the accompanying drawings.

Figure 1:
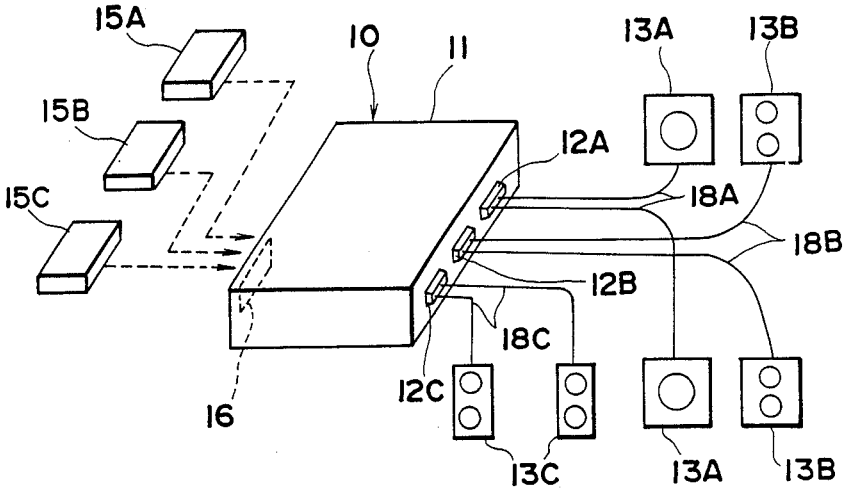
FIG. 1 is a schematic perspective view showing a basic arrangement of a driving apparatus according to an embodiment of the present invention.
Figure 2:
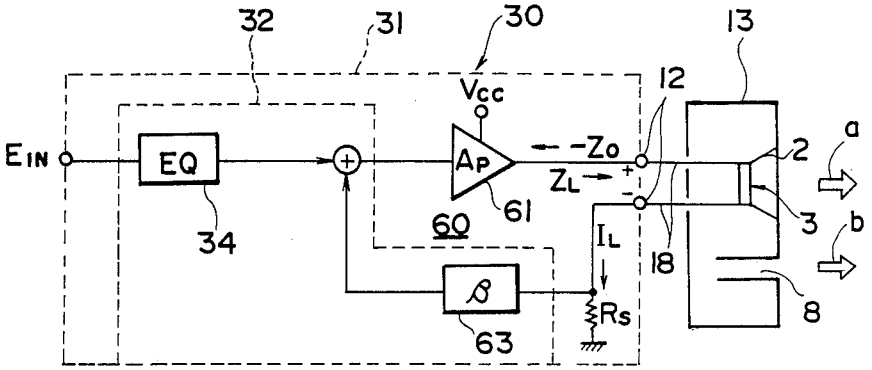
FIG. 2 is a circuit diagram for explaining the circuit arrangement of the driving apparatus shown in FIG. 1.
Figure 3:
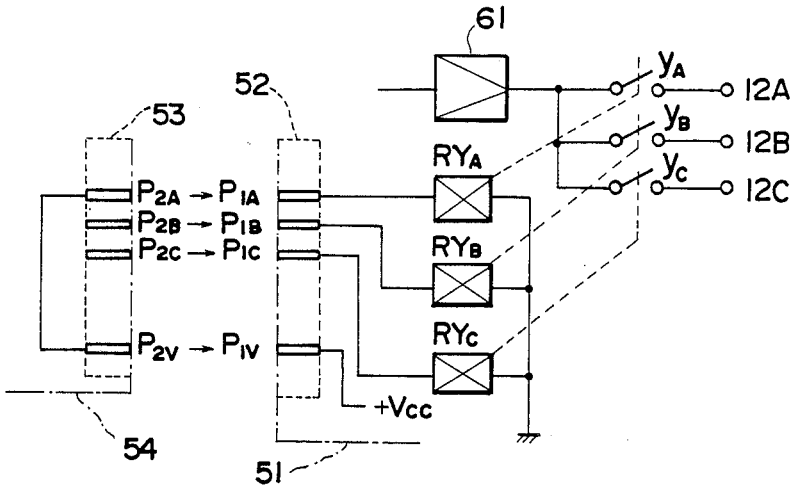
FIG. 3 is a circuit diagram showing a first embodiment of a speaker selection means used in the driving apparatus shown in FIG. 1.

FIG. 1 shows the outer appearance and the overall arrangement of a driving apparatus according to an embodiment of the present invention, FIG. 2 shows a basic circuit arrangement of the driving apparatus, and FIG. 3 shows a detailed arrangement of a speaker selection means arranged in the driving apparatus.

In FIG. 1, three connection terminals 12A, 12B, and 12C are arranged on an outer side surface of a case 11 of a driving apparatus main body 10. The connection terminals 12A, 12B, and 12C are respectively connected to pairs of speaker systems, e.g., a closed type speaker system 13A, and speaker systems 13B and 13C with resonance ports. The main body case 11 houses a main body circuit board 51 (FIG. 3) on which a main body circuit portion 31 (FIG. 2) is formed. A connector (jack) 52 for connecting a cartridge 15A, 15B, or 15C to the circuit portion 31 is arranged on the circuit board 51. The cartridges 15A, 15B, and 15C are prepared in correspondence with the speaker systems 13A, 13B, and 13C, respectively. Each cartridge houses a cartridge circuit board 54 on which a connector (plug) 53 (FIG. 3) and a cartridge circuit portion 32 are arranged. The connector 53 can be connected to the connector 52. A mounting port 16 for selectively connecting one of the cartridges 15A, 15B, and 15C to the connector 52 is arranged in the main body case 11. Each of the cartridges 15A, 15B, and 15C has a speaker selection information means.

FIG. 3 shows a detailed arrangement of the speaker selection means. The speaker selection means is constituted by the connector 53 arranged on the cartridge circuit board 54 as a speaker selection information means, and the connector 52 and relays $RY_A$, $RY_B$, and $RY_C$ arranged on the main body circuit board 51 respectively as a speaker selection control means and amplifier output selection means. In the main body circuit board 51, one end of each of the relays $RY_A$, $RY_B$, and $RY_C$ is connected to a corresponding one of connection pins $P_{lA}$, $P_{lB}$, and $P_{lC}$ of the connector 52, and the other end thereof is grounded. Normally-open contacts $y_A$, $y_B$, and $y_C$ of the relays $RY_A$, $RY_B$, and $RY_C$ are respectively connected between the output terminal of an amplifier 61 and the speaker connection terminals 12A, 12B, and 12C. A connection pin $P_{lV}$ of the connector 52 is connected to a power supply $V_{CC}$.

In this case, the cartridge circuit board 54 exemplifies a circuit board in the cartridge 15A for selecting the connection terminal 12A, and connection pins $P_{2V}$ and $P_{2A}$ of the connector 53 are connected to each other. In the cartridge 15B for selecting the connection terminal 12B, connection pins $P_{2B}$ and $P_{2V}$ of the connector 53 are connected to each other. In the cartridge 15C for selecting the connection terminal 12C, connection pins $P_{2C}$ and $P_{2V}$ of the connector 53 are connected to each other.

In this driving apparatus, the speaker systems 13A, 13B, and 13C are connected in advance to the connection terminals 12A, 12B, and 12C through connection cords 18A, 18B, and 18C, respectively. When a desired speaker system 13 (one of 13A, 13B, and 13C) is used, a cartridge 15 (one of 15A, 15B, and 15C) corresponding to the speaker system 13 is mounted on the driving apparatus main body 10, and the connector 52 of the main body circuit board 51 is connected to the connector 53 of the cartridge circuit board 54. For example, if the cartridge 15A shown in FIG. 3 is mounted, the relay $RY_A$ is energized by the power supply $V_{CC}$ of the main body circuit board 51 through a path consisting of the connection pin $P_{lV}$ of the connector 52, the connection pins $P_{2V}$ and $P_{2A}$ of the connector 53 arranged on the cartridge circuit board 54, the connection pin $P_{lA}$ of the main body circuit board 51, and the relay $RY_A$, and the contact $y_A$ is closed to connect the output terminal of the amplifier 61 to the connection terminal 12A. That is, when the cartridge 15A is mounted, the speaker system 13A is automatically selected. Similarly, when the cartridge 15B is mounted, the speaker system 13B is automatically selected, and when the cartridge 15C is mounted, the speaker system 13C is automatically selected. Upon mounting of the cartridge 15, a driver 30 (FIG. 2) including an equalizer circuit 34 and a negative impedance circuit 60 whose frequency characteristics f ($f_A$, $f_B$, $f_C$) and a negative resistance $-R_0$ are set to have optimal values with respect to the above-mentioned characteristic values ($f_{oc}'$, $Q_{oc}'$) and the voice coil resistance $R_V$ ($R_{VA}$, $R_{VB}$, $R_{VC}$) is formed, and the speaker system 13 is driven to exhibit designed characteristics.

(Another Embodiment)

Figure 4:
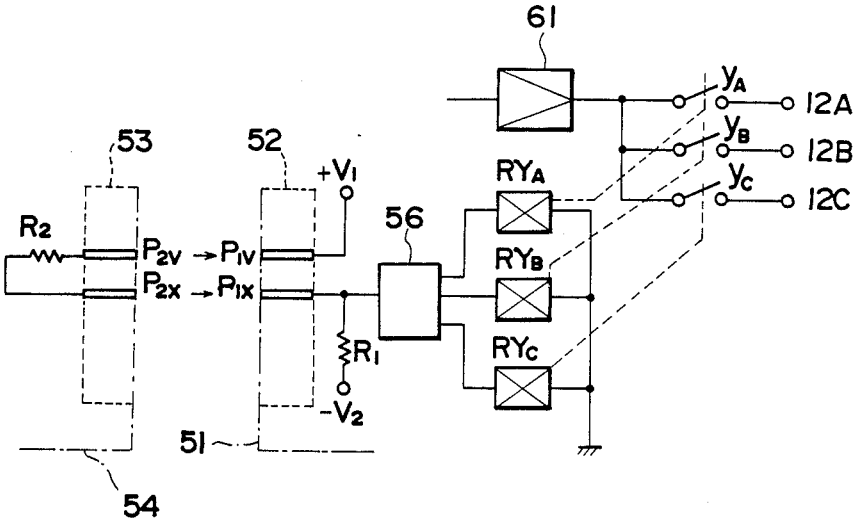
FIG. 4 is a circuit diagram showing a second embodiment of a speaker selection means used in the driving apparatus shown in FIG. 1.

FIG. 4 shows another embodiment of the speaker selection means. The speaker selection means shown in FIG. 4 is constituted by a resistor $R_2$ connected between connection pins $P_{2X}$ and $P_{2V}$ of a connector 53 arranged on a cartridge circuit board 54 as a speaker selection information means, and a resistor $R_1$ arranged on a main body circuit board 51 and a voltage determination circuit 56 as a speaker selection control means. As an amplifier output selection means, relays $RY_A$, $RY_B$, and $RY_C$ are used as in the speaker selection means shown in FIG. 3.

More specifically, in the main body circuit board 51, a connection pin $P_{lV}$ of a connector 52 is connected to a power supply $+V_1$, and a connection pin $P_{lX}$ is connected to a power supply $-V_2$ through the resistor $R_2$. The voltage determination circuit 56 has one input terminal and three output terminals for selectively outputting a determination signal in accordance with an input voltage. The input terminal of the circuit 56 is connected to the connection pin $P_{lX}$, and the output terminals are respectively connected to the relays $RY_A$, $RY_B$, and $RY_C$. Normally-open contacts $y_A$, $y_B$, and $y_C$ of the relays $RY_A$, $RY_B$, and $RY_C$ are connected between the output terminal of an amplifier 61 and speaker connection terminals 12A, 12B, and 12C as in FIG. 3.

In the driving apparatus using the speaker selection means shown in FIG. 4, when a cartridge 15 is mounted on a driving apparatus main body 10 while speaker systems are respectively connected to speaker connection terminals 12A, 12B, and 12C, a current flows along a path consisting of the power supply $+V_1$ and the connection pin $P_{lV}$ of the main body circuit board 51, the connection pin $P_{2V}$, the resistor $R_2$, and the connection pin $P_{2X}$ of the cartridge circuit board 54, and the connection pin $P_{lX}$ and the resistor $R_1$ of the main body circuit board 51, and a voltage $(R_1V_1-R_2V_2)/(R_1+R_2)$ obtained by dividing the power supplies $+V_1$ and $-V_2$ by the resistors $R_1$ and $R_2$ appears at the connection pin $P_{IX}$, i.e., the input terminal of the voltage determination circuit 56. This voltage takes low, middle, and high levels according to high, middle, and low resistances of the resistance $R_2$. The voltage determination circuit 56 generates a determination output to one of the output terminals in accordance with this voltage, and drives the relay connected to the selected output terminal. For example, if the resistance of the resistor $R_2$ is "H", the relay $RY_A$ is driven in accordance with "low" divided voltage. Thus, the contact $y_A$ is closed, and the output terminal of the amplifier 61 is connected to the speaker connection terminal 12A, thereby automatically selecting the speaker system 13A. When the resistance of the resistor $R_2$ is "middle", the speaker system 13B is automatically selected through the contact $y_B$ of the relay $RY_B$; when the resistance of the resistor $R_2$ is "high", the speaker system 13C is automatically selected through the contact $y_C$ of the relay $RY_C$.

This embodiment exemplifies a case wherein the speaker selection information of the cartridge 15 is fixed. If this information is variably set, the driving apparatus of the present invention can have higher compatibility.

Figures 5A, 5B, 5C:
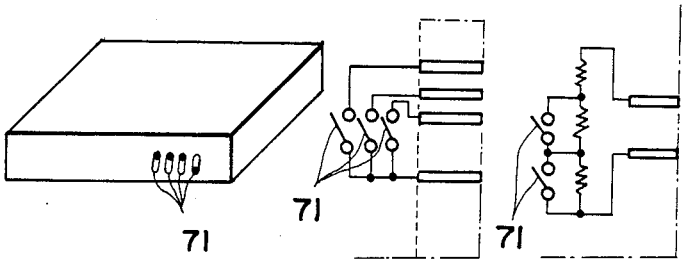
FIGS. 5(*a*), 5(*b*), and 5(*c*) are respectively a schematic view and circuit diagrams showing a modification of the speaker selection means shown in FIGS. 3 and 4.
Figure 6:
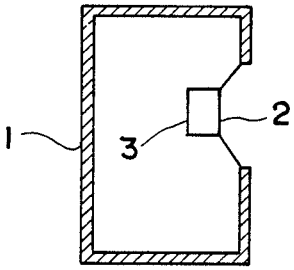
PRIOR ART FIG. 6
FIG. 6 is a sectional view showing a structure of a conventional closed type speaker system.
Figure 7:
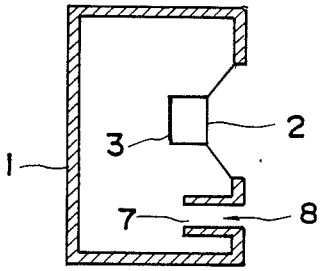
PRIOR ART FIG. 7
FIG. 7 is a sectional view showing an arrangement of a conventional bass-reflex type speaker system.
Figure 8:
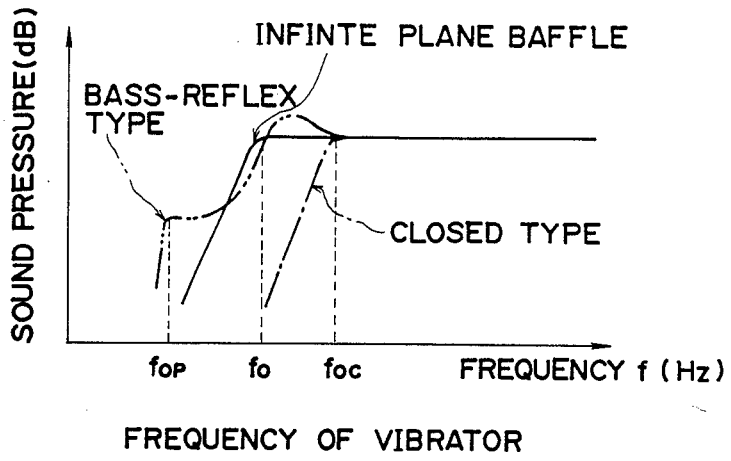
FIG. 8 is a graph showing sound pressure characteristics of the speaker systems shown in FIGS. 6 and 7.
Figure 10:
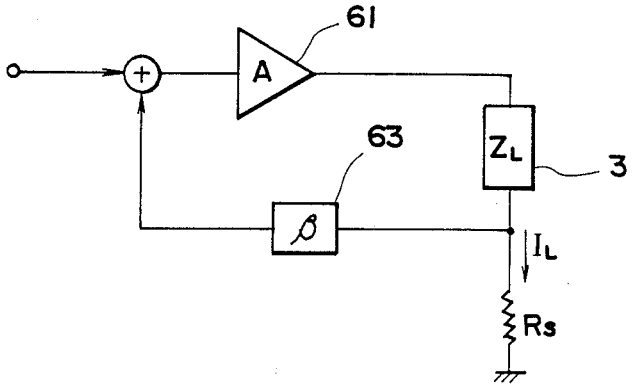
FIG. 10 is a circuit diagram showing a basic arrangement of a circuit for equivalently generating a negative impedance according to the prior application.
Figure 9A:
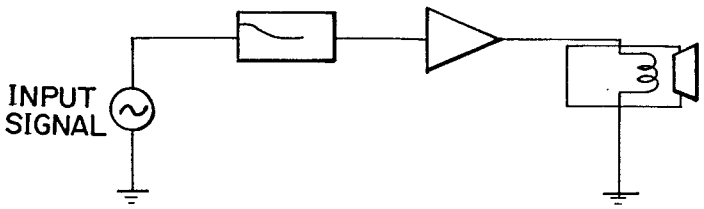
FIGS. 9(*a*) to 9(*d*) are respectively a circuit diagram and graphs for explaining a circuit and frequency characteristics when a speaker unit attached to a compact cabinet is constant-voltage driven by a bass-tone boosted, signal.
Figures 9B, 9C, 9D:
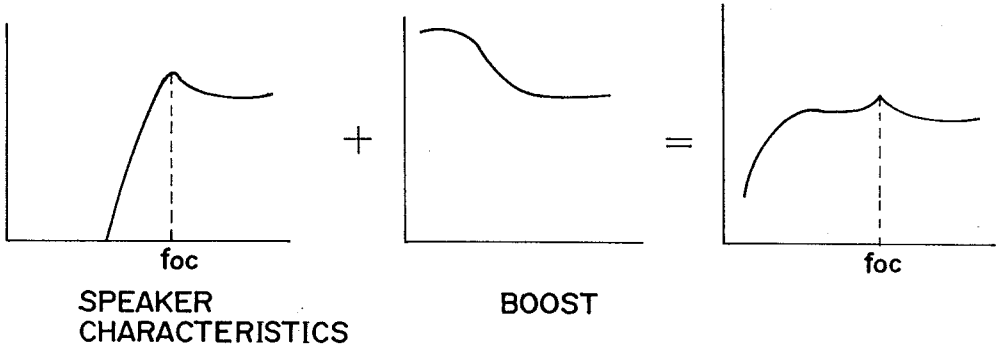

FIGS. 5(*a*) to 5(*c*) show an embodiment wherein speaker selection information can be variably set by arranging dip switches 71 to the cartridge 15. FIG. 5(*a*) shows an outer appearance of the cartridge 15, FIG. 5(*b*) is a circuit diagram of a speaker selection means portion when speaker selection information setting dip switches 71 are applied to the cartridge 15 of the manner of FIG. 3, and FIG. 5(*c*) is a circuit diagram of a speaker selection means portion when speaker selection information setting dip switches 71 are applied to the cartridge 15 of the manner of FIG. 4.

In the above embodiment, all cartridges 15 store control information for generating a specific negative resistance $-R_0$ and frequency characteristics. However, some cartridges may store control information for selecting $-R_0=0$ and flat frequency characteristics, i.e., for selecting normal driving.

What is claimed is:

1. A driving apparatus which comprises:

a power amplifier for supplying a drive power to an electro-acoustic transducer;

a feedback circuit for detecting a magnitude of a signal flowing across said transducer and transmitting a detected result to the input side of said amplifier, said feedback circuit having a determining means which is separated into a main body portion connected to said amplifier and a control information storage body, which is arranged to be detachably connected to said main body portion, for storing control information for setting transmission characteristics of said feedback circuit, wherein said amplifier drives said transducer in accordance with the detected result of the feedback circuit;

a plurality of transducer connection terminals on the amplifier for connection to a plurality of transducers, respectively;

an amplifier output selection means for selectively supplying an amplifier output to said transducer connection terminals;

a transducer selection information means housed in said control information storage body; and a transducer selection control means for, when said control information storage body is mounted, determining the transducer selection information, and driving said amplifier output selection means on the basis of the determination result to control so as to supply the amplifier output to a predetermined transducer.

2. An apparatus according to claim 1, wherein said transducer selection control means comprises a power supply for driving said amplifier output selection means, and at least one control signal input terminal for being supplied with a control signal for controlling the amplifier output selection means, said transducer selection information means connecting said control signal input terminal with said power supply under a predetermined condition according to said control information.

3. An apparatus according to claim 2, wherein a plurality of control signal input terminals are provided, the number of the input terminals corresponding to that of said transducer connection terminals, and said transducer selection information means connects one of said control signal input terminals with said power supply to select one of said transducer connection terminals.

4. An apparatus according to claim 2, wherein said transducer selection control means detects a magnitude of voltage applied to said control signal input terminal to control said amplifier output selection means, and said transducer selection information means comprises a resistor connected between said control signal input terminal and said power supply.

5. An apparatus according to claim 1, wherein the output of said amplifier is applied to said transducer so as to effect constant-voltage driving of the transducer when said transducer selection information means stores therein a transducer selection information for a constant-voltage driven type transducer.

6. A control information storage body according to claim 1, which comprises an information switching means for switching said transducer selection information means to switch said transducer to be selected.

7. An apparatus according to claim 1, wherein said amplifier output selection means is constituted of a plurality of switching circuits respectively corresponding to said transducer connection terminals.

8. An apparatus according to claim 1 wherein said feedback circuit causes the amplifier to drive the transducer to substantially cancel an impedance of the transducer.

9. An apparatus according to claim 1, further comprising a frequency characteristic correction circuit which is connected to an input side of said power amplifier, and can set frequency characteristics complementarily to frequency characteristics of an output sound pressure of said electro-acoustic transducer to be driven.

10. An apparatus according to claim 9, wherein said control information storage body stores second control information for setting frequency characteristics of said frequency characteristic correction circuit.

* * * * *